US007140748B2

(12) United States Patent
Chien

(10) Patent No.: US 7,140,748 B2
(45) Date of Patent: Nov. 28, 2006

(54) LED FLASHLIGHT

(76) Inventor: Ming-Chuan Chien, No. 41, Lane 197, Jhengguang St., Taiping City, Taichung County 411 (TW)

( * ) Notice: Subject to any disclaimer, the term of this patent is extended or adjusted under 35 U.S.C. 154(b) by 40 days.

(21) Appl. No.: 11/078,433

(22) Filed: Mar. 14, 2005

(65) Prior Publication Data

US 2006/0203477 A1 Sep. 14, 2006

(51) Int. Cl.
*F21L 4/04* (2006.01)
*F21L 4/00* (2006.01)

(52) U.S. Cl. ..... 362/205; 362/202; 362/208

(58) Field of Classification Search ..... 362/205, 362/202, 208
See application file for complete search history.

(56) References Cited

U.S. PATENT DOCUMENTS 6,474,833 B1 * 11/2002 Parsons et al. ..... 362/205
6,533,445 B1 * 3/2003 Rogers ..... 362/540
6,814,466 B1 * 11/2004 Parsons et al. ..... 362/205
6,834,976 B1 * 12/2004 Galli ..... 362/158
2005/0254234 A1 * 11/2005 Wang ..... 362/184

* cited by examiner

*Primary Examiner*—Renee Luebke
*Assistant Examiner*—David Makiya
(74) *Attorney, Agent, or Firm*—Rosenberg, Klein & Lee

(57) ABSTRACT

An LED flashlight including a barrel body and a press button disposed on the barrel body. An inner barrel is disposed in a receiving space of the barrel body. The inner barrel has support structures for supporting a circuit board to which the pressing force of the press button is applied. Accordingly, when pressing down the press button, the support structures can bear the pressing force so as to protect the circuit board and prolong using life of the LED flashlight.

7 Claims, 5 Drawing Sheets

LED FLASHLIGHT

BACKGROUND OF THE INVENTION

The present invention is related to an LED flashlight, and more particularly to an LED flashlight in which an inner barrel is additionally disposed for reinforcing the circuit board.

FIG. 5 shows a conventional LED flashlight having a barrel body 7, a head section 71 and a rear cap 72. A circuit board 8 is arranged in the barrel body 7. A controlling loop is laid on the circuit board 8. The controlling loop is connected with several LED bulbs 711 located in the head section and the cells placed in the barrel body 7. The circuit board 8 is equipped with a switch 81 for turning on/off the controlling loop. A press button 73 is disposed through the barrel body 7 corresponding to the circuit board 8. The press button 73 abuts against the switch 81 of the circuit board 8 for turning on/off the controlling loop thereof. Accordingly, by means of the press button, the LED bulbs 711 can be controllably turned on/off.

In operation, a user can press or release the press button 73 to turn on or off the LED bulbs 711.

However, the press button 73 is manually pressed down to touch the switch 81 of the circuit board 8. In the case that the pressing force is too great or the press button 73 is too frequently pressed and released, the switch 81 or the circuit board 8 itself may be broken or damaged by the excessively great force. As a result, the using life of the LED flashlight is shortened.

SUMMARY OF THE INVENTION

It is therefore a primary object of the present invention to provide an improved LED flashlight including a barrel body and a press button disposed on the barrel body. An inner barrel is disposed in a receiving space of the barrel body. The inner barrel has support structures for supporting a circuit board to which the pressing force of the press button is applied. Accordingly, when pressing down the press button, the support structures can bear the pressing force so as to protect the circuit board and prolong using life of the LED flashlight.

According to the above object, the LED flashlight of the present invention includes:

a barrel body having an internal receiving space, a press button being disposed on the barrel body;

a bulb seat disposed in the receiving space of the barrel body, at least one LED bulb being arranged in the bulb seat, a first circuit board being disposed on the bulb seat to connect with the LED bulb, the first circuit board being connected with a second circuit board, the second circuit board having a top face, a bottom face corresponding to the top face and lateral edges between the top face and the bottom face, the second circuit board being connected with a third circuit board having two one power terminal, the first circuit board and the third circuit board being both connected with opposite lateral edges of the second circuit board;

a power supply disposed in the receiving space corresponding to the third circuit board, the power supply serving to supply power for the power terminals of the third circuit board;

a bulb shade covering the LED bulbs, the bulb shade being screwed on one end of the barrel body; and a rear cap screwed on the other end of the barrel body distal from the bulb shade.

The rear cap has a magnet. A switch is disposed on the top face of the second circuit board. The switch protrudes from the top face and can be pressed from the top face to the bottom face.

An inner barrel is disposed in the receiving space of the barrel body and adapted to the second circuit board. The inner barrel has a receiving chamber having a first opening and a second opening opposite to the first opening. The bulb seat is fitted in the first opening. The power terminal of the third circuit board is exposed through the second opening. A third opening is formed on a lateral side of the receiving chamber. The switch protrudes from the receiving chamber through the third opening to abut against the press button of the barrel body. The second circuit board extends into the receiving chamber. The receiving chamber has support structures for supporting the second circuit board. An outer circumference of the inner barrel is formed with at least one axial straight rail. The barrel body is formed with at least one rib corresponding to the rail. The rib is inlaid in the rail.

The present invention can be best understood through the following description and accompanying drawings wherein:

DETAILED DESCRIPTION OF THE PREFERRED EMBODIMENTS

Figure 1:
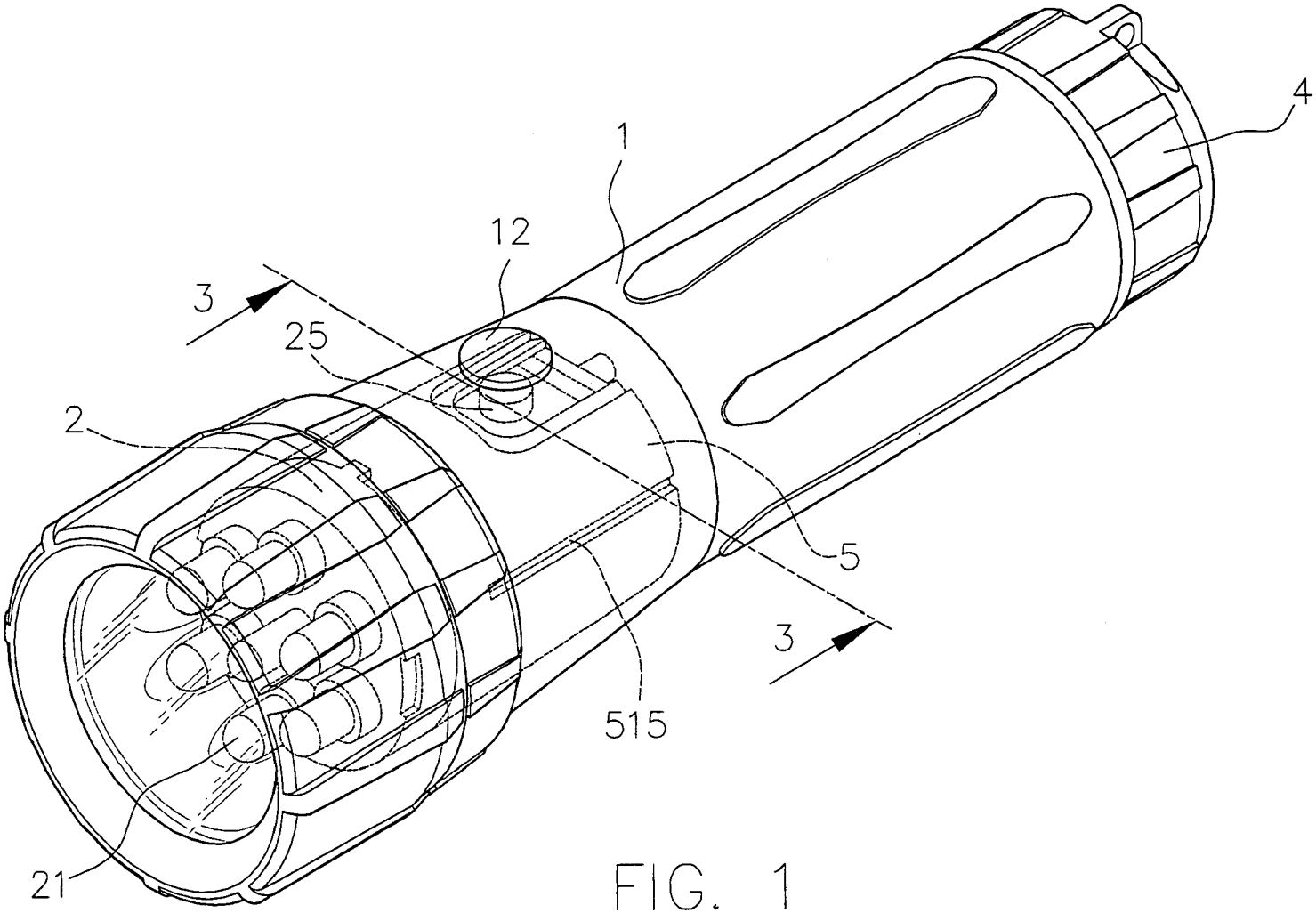
FIG. 1 is a perspective assembled view of the present invention.
Figure 2:
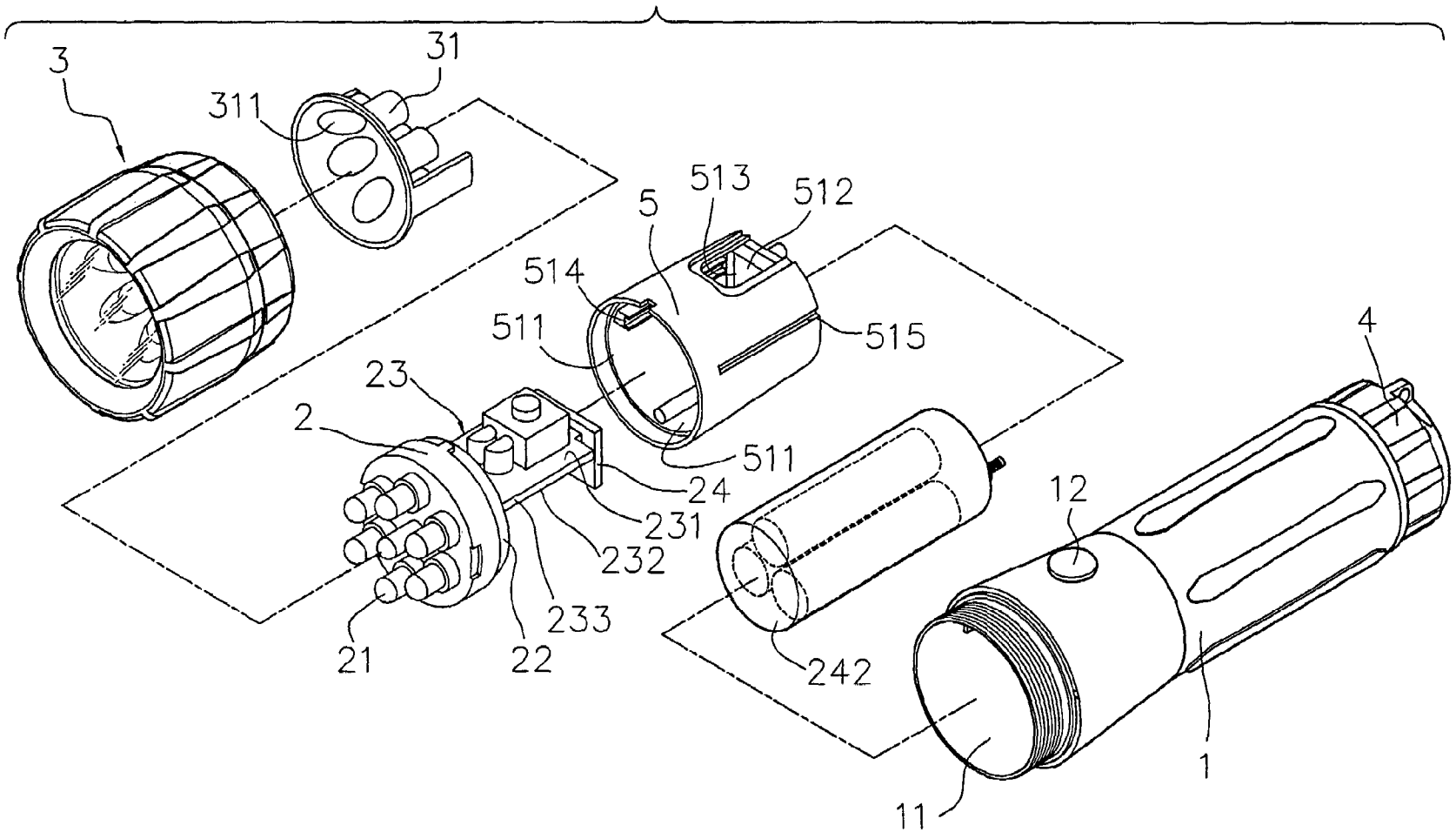
FIG. 2 is a perspective exploded view of the present invention.
Figure 3:
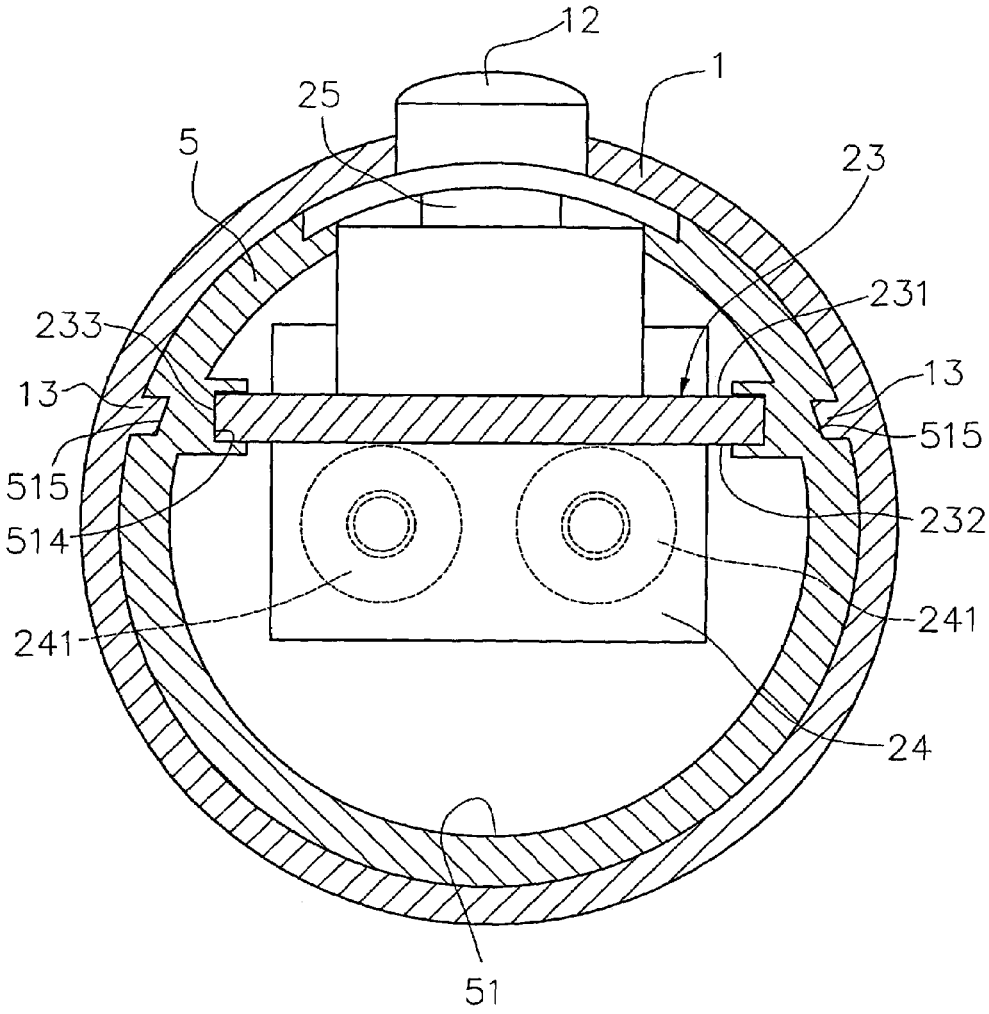
FIG. 3 is a sectional view taken along line 3—3 of FIG. 1.

Please refer to FIGS. 1 to 3. The LED flashlight of the present invention includes a barrel body 1 having an internal receiving space 11 communicating with two ends of the barrel body 1. A press button 12 is disposed through a lateral side of the barrel body 1.

The LED flashlight further includes a bulb seat 2 disposed at one end of the barrel body 1 and accommodated in the receiving space 11. Several LED bulbs 21 are arranged in the bulb seat 2. The bulb seat 2 is connected with a first circuit board 22 to connect with the LED bulbs. The first circuit board 22 is connected with a second circuit board 23. The second circuit board 23 has a top face 231, a bottom face 232 corresponding to the top face 231 and lateral edges 233 between the top face 231 and the bottom face 232. The second circuit board 23 is connected with a third circuit board 24 having two power terminals 241. The first circuit board 22 and the third circuit board 24 are both connected with the opposite lateral edges 233 of the second circuit board 23.

A power supply 242 is disposed in the receiving space 11 corresponding to the third circuit board 24. The power supply 242 serves to supply power for the power terminals 241 of the third circuit board 24.

The flashlight further includes a bulb shade 3 covering the LED bulbs 21. The bulb shade 3 is screwed on one end of the barrel body 1. A reflective mirror seat 31 is disposed in the bulb shade 3. The reflective mirror seat 31 is formed with several holes 311 corresponding to the LED bulbs 21. When the bulb shade 3 covers the LED bulbs 21, the LED bulbs 21 respective extend through the holes 311.

The present invention further includes a rear cap 4 screwed on the other end of the barrel body 1 distal from the bulb shade 3. The rear cap 4 is equipped with a magnet (not shown).

A switch 25 is disposed on the top face 231 of the second circuit board 23. The switch 25 protrudes from the top face 231 and can be pressed from the top face 231 to the bottom face 232. An inner barrel 5 is disposed in the receiving space 11 of the barrel body 1 and adapted to the second circuit board 23. The inner barrel 5 has a receiving chamber 51 in which the bulb seat 2 is fitted. The receiving chamber 51 has a first opening 511 and a second opening 512 opposite to the first opening 511. The bulb seat 2 is fitted in the first opening 511. The power terminals 241 of the third circuit board 24 are exposed through the second opening 512. A third opening 513 is formed on a lateral side of the receiving chamber 51. The switch 25 protrudes from the receiving chamber 51 through the third opening 513 to abut against the press button 12 of the barrel body 1. The receiving chamber 51 has two support structures. In this embodiment, the two support structures are two flutes 514 axially arranged in the receiving chamber 51. The lateral edges 233 of the second circuit board 23 are fitted in the flutes 514 to support the second circuit board 23. The outer circumference of the inner barrel 5 is formed with two axial straight rails 515. The barrel body 1 is formed with two ribs 13 corresponding to the rails 515. The ribs 13 are inlaid in the rails 515.

In operation, the depressing force exerted onto the press button 12 will be applied to the switch 25 to press the second circuit board 23. The depressing force exerted onto the second circuit board 23 will be spread from the inner barrel 5 to the flutes 514 thereof. Therefore, the flutes 514 can bear the depressing force.

Accordingly, the force applied by a user is distributed over the inner barrel 5 so as to protect the second circuit board 23 from being damaged by the concentrated stress.

Figure 4:
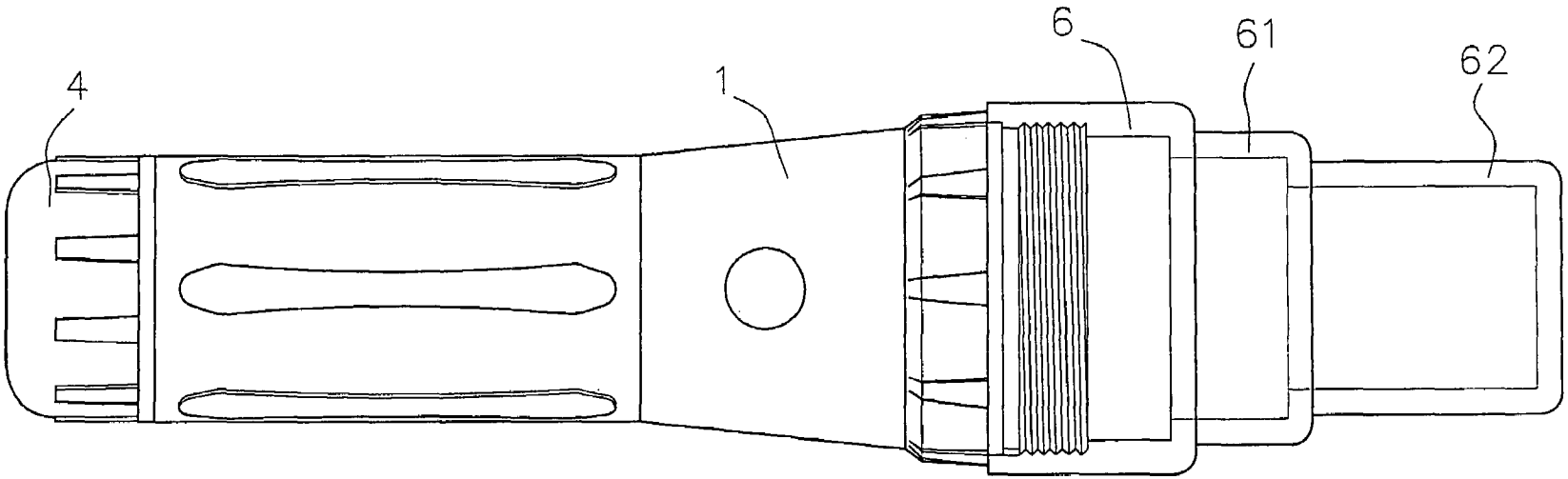
FIG. 4 is a plane view of a second embodiment of the present invention.
Figure 5:
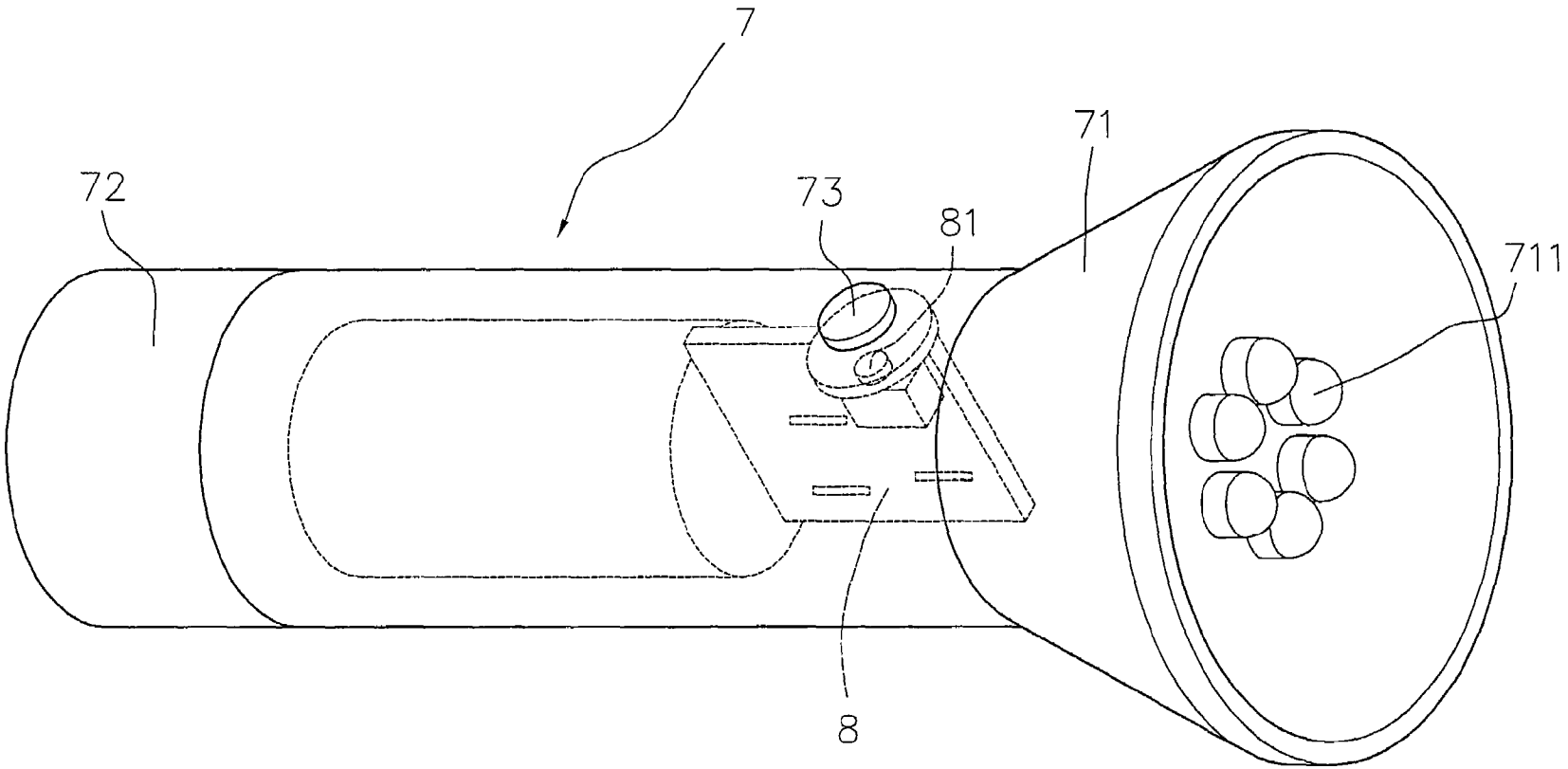
FIG. 5 PRIOR ART
FIG. 5 is a perspective view of a conventional LED flashlight.

FIG. 4 shows a second embodiment of the present invention, in which a transparent bulb shade 6 is screwed on the barrel body 1. The bulb shade 6 has a first small diameter section 61 axially extending away from the barrel body 1. The first small diameter section 61 has a diameter smaller than that of the barrel body 1. A second small diameter section 62 axially extends from the first small diameter section 61. The second small diameter section 62 has a diameter smaller than that of the first small diameter section 61. This embodiment is applicable to a common traffic control bar.

The above embodiments are only used to illustrate the present invention, not intended to limit the scope thereof. Many modifications of the above embodiments can be made without departing from the spirit of the present invention.

What is claimed is:

1. An LED flashlight comprising:

a barrel body having an internal receiving space, a press button being disposed on the barrel body;

a bulb seat disposed in the receiving space of the barrel body, at least one LED bulb being arranged in the bulb seat, a first circuit board being disposed on the bulb seat to connect with the LED bulb, the first circuit board being connected with a second circuit board, the second circuit board having a top face, a bottom face corresponding to the top face and lateral edges between the top face and the bottom face, the second circuit board being connected with a third circuit board having at least one power terminal, a switch being disposed on the second circuit board corresponding to the press button of the barrel body, the first circuit board and the third circuit board being both connected with opposite lateral edges of the second circuit board;

a power supply disposed in the receiving space corresponding to the third circuit board, the power supply serving to supply power for the power terminal of the third circuit board;

a bulb shade covering the LED bulbs, the bulb shade being connected with the barrel body; and a rear cap connected with one end of the barrel body distal from the bulb shade, said LED flashlight being characterized in that an inner barrel is disposed in the receiving space of the barrel body, the inner barrel having a receiving chamber having a first opening and a second opening opposite to the first opening, the bulb seat being fitted in the first opening, the power terminal of the third circuit board being exposed through the second opening, a third opening being formed on a lateral side of the receiving chamber, the switch protruding from the receiving chamber through the third opening, the second circuit board extending into the receiving chamber, the receiving chamber having support structures for supporting the second circuit board.

2. The LED flashlight as claimed in claim 1, wherein the bulb shade is screwed on the barrel body.

3. The LED flashlight as claimed in claim 1, wherein the rear cap is screwed on the barrel body.

4. The LED flashlight as claimed in claim 1, wherein the rear cap has a magnet.

5. The LED flashlight as claimed in claim 1, wherein the support structures are a set of flutes axially arranged in the receiving chamber, the lateral edges of the second circuit board being fitted in the flutes.

6. The LED flashlight as claimed in claim 1, wherein an outer circumference of the inner barrel is formed with at least one axial straight rail, the barrel body being formed with at least one rib corresponding to the rail, the rib being inlaid in the rail.

7. The LED flashlight as claimed in claim 1, wherein the bulb shade is made of transparent material, the bulb shade having at least one small diameter section axially extending away from the barrel body, the small diameter section having a diameter smaller than that of the barrel body.

* * * * *